United States Patent [19]

Guinard

[11] Patent Number: 4,563,850

[45] Date of Patent: Jan. 14, 1986

[54] DEVICES FOR ASSEMBLING TOGETHER THE SLABS OF CONCRETE CONSTITUTING HIGHWAYS

[75] Inventor: Pierre Guinard, Maintenon, France

[73] Assignee: Freyssinet International (STUP), Boulogne Billancourt, France

[21] Appl. No.: 626,317

[22] Filed: Jun. 29, 1984

[30] Foreign Application Priority Data

Jul. 1, 1983 [FR] France ..... 83 11003

[51] Int. Cl.[4] ..... E01C 23/03

[52] U.S. Cl. ..... 52/396; 52/573; 404/51; 404/56; 404/65

[58] Field of Search ..... 404/50, 51, 56, 64, 404/65; 52/396, 573, 582, 583–586, 589

[56] References Cited

U.S. PATENT DOCUMENTS 3,099,110 7/1963 Spaight ..... 404/50
3,884,005 5/1975 Wey ..... 52/585

FOREIGN PATENT DOCUMENTS 1200506 9/1965 Fed. Rep. of Germany ..... 52/583
2412651 7/1979 France .
2415690 9/1979 France ..... 404/56

*Primary Examiner*—John E. Kittle
*Assistant Examiner*—James J. Seidleck
*Attorney, Agent, or Firm*—Ned L. Conley; David A. Rose; William E. Shull

[57] ABSTRACT

For joining together two concrete slabs (1, 2) juxtaposed side by side along a crack (3), a cylindrical cartridge with vertical axis is used comprising two half shells ($4_1$, $4_2$) made from cast metal and joined vertically together by a key (11) housed in recesses ($10_1$, $10_2$) each formed in a central projecting step ($9_1$, $9_2$), these half shells being urged mutually horizontally apart by a continuous elastic belt (12) made from an elastomer material adapted to ensure sealed isolation of the inside of the cartridge with respect to the outside.

9 Claims, 4 Drawing Figures

DEVICES FOR ASSEMBLING TOGETHER THE SLABS OF CONCRETE CONSTITUTING HIGHWAYS

BACKGROUND OF THE INVENTION

The invention relates to devices for assembling together side by side the concrete slabs constituting highway surfaces or similar areas such as airport runways, at their junction zones, said zones being in the form of substantially flat and vertical interfaces or cracks.

By "slabs" is meant in the present description not only slabs properly speaking, produced individually and juxtaposed side by side during the construction of the highway, but also pieces of such slabs created by local cracking thereof, such cracking being either started voluntarily by creating special grooves in the upper surfaces of the slabs, or involuntarily because more especially of bad weather or defects of homogeneity in the foundation layer on which the slabs rest.

The problem which the invention proposes solving is that of the lateral coupling together of the slabs in question at the level of their zones of join so as to make possible slight mutual horizontal movements of the slab edges defining these zones perpendicularly to the mean surfaces of said zones, movements generated more especially by temperature variations in the slabs, but preventing the mutual vertical movements of said edges: these movements are in fact causes of deterioration for the edges in question and the vertical displacements which result therefrom are disagreeable for the users of vehicles travelling along the corresponding highways.

To ensure such a mutual coupling of slabs, it has already been proposed to place cylindrical connecting pieces of vertical axis into complementary cylindrical housings made astride the zones of join concerned, these pieces being elastically compressible in the horizontal direction perpendicular to the mean surface of the zone of join and adhering respectively on the two edges of slabs which define this zone so as to join them together vertically.

In patent FR No. 2 412 651, it was proposed to provide the connecting pieces of the kind in question with two rigid semi cylindrical half shells which are joined together vertically, but not horizontally, by a rigid inner key adapted to slide horizontally, are urged horizontally apart by elastic means and have two facing peripheral bearing surfaces joined together by a seal.

The solution which was proposed in said patent for forming the connecting pieces considered has a certain number of disadvantages, in particular the following:

the need to use different elastic materials for forming the element which ensure respectively the elastic expansion and the sealing, the smallness of the mutual bearing surfaces ensuring the vertical transfer of loads between each half shell and the inner key, and so the short life-span of these pieces, which are subjected in use to incessant hammering the absence of a horizontal abutment adapted to limit the crushing of the elastic masses providing the elastic expansion.

SUMMARY OF THE INVENTION

The aim of the invention is especially to overcome these different disadvantages by proposing a particularly efficient and long lasting construction for the connecting pieces in question.

To this end, these connecting pieces according to the invention are essentially characterized in that, on the one hand, the elastic means are essentially formed by a thick belt interposed between the two peripheral bearing surfaces and forming itself the seal and in that, on the other hand, the key is housed in two recesses formed respectively in two steps each forming part of a half shell and each projecting towards the other beyond the plane of the peripheral bearing surface included in said half shell.

In preferred embodiments, one or more of the following arrangements are also employed:

the key is formed by a piece having in cross section the form of an ellipse with small truncated ends, the steps are disposed in the center of the half shells, the belt forms a single block with inner bosses housed respectively in complementary cavities formed in the two half shells, the above bosses have relatively large dimensions and are formed by tunnels which pass therethrough from one side to the other, the elastic material monoblock piece forming the belt and the bosses has formed therein grooves along the joining zone between this belt and these bosses, the free volume inside the belt is filled with grease.

The invention comprises, apart from these main arrangements, certain other arrangements which are preferably used at the same time and which will be discussed more explicitly hereafter.

BRIEF DESCRIPTION OF THE DRAWINGS

In what follows, a preferred embodiment of the invention will be described with reference to the accompanying drawings in a way which is of course in no wise limiting.

DETAILED DESCRIPTION OF THE PREFERRED EMBODIMENT

Figure 1:
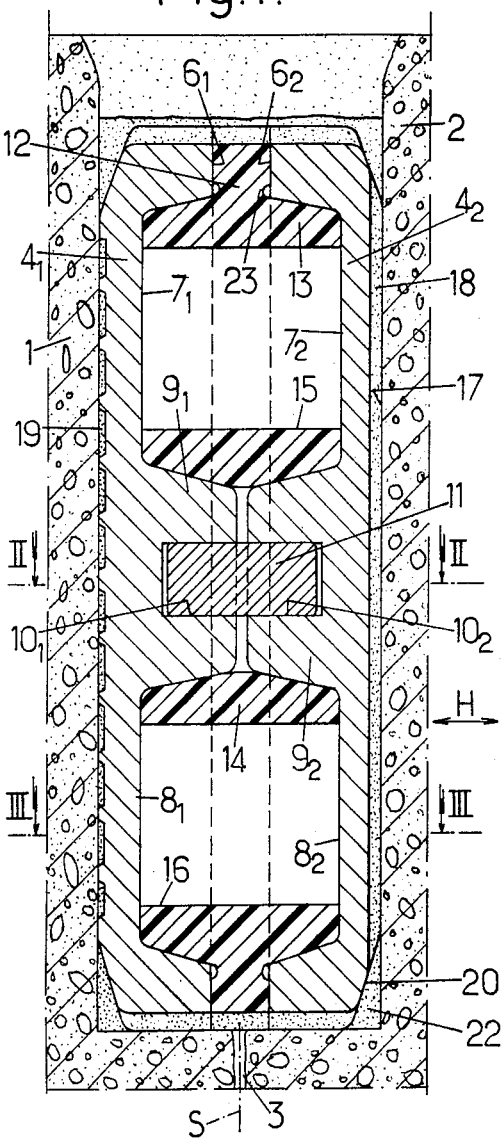
FIGS. 1, 2 and 3 of these drawings show respectively in vertical section along 1—1 of FIG. 2, in horizontal section along II—II of FIG. 1 and along III—III of FIG. 1, a cartridge according to the invention for connecting slabs.

The problem to be solved is that of the mutual connection of concrete slabs 1, 2, (FIG. 1) juxtaposed horizontally side by side on the same foundation layer so as to form a highway surface or other similar area such as an airport runway.

The mutual juxtaposition of these slabs is effected along vertical facing edges defining therebetween cracks 3 created voluntarily (at right angles to upper grooves created for this purpose in the top of the slabs) or involuntarily.

In a way known per se, a cylindrical cartridge is assembled astride the crack 3, between the two slabs 1 and 2 to be connected together, the vertical axis of said cartridge being placed in the generally flat mean surface S of said crack, said cartridge being formed of two rigid elements joined together so that:

on the one hand, they are joined vertically together, and, on the other hand, they are horizontally movable with respect to each other in direction H perpendicular to the surface S, being to this end urged permanently apart.

The two rigid elements in question are in the form of two half shells $4_1$, $4_2$ open towards each other, preferably identical to each other and formed advantageously of malleable cast iron.

These two half shells are each defined outwardly by a surface $5_1$, $5_2$ having substantially the form of a semi-cylinder of revolution, which surface is bordered by a peripheral flat bearing surface $6_1$, $6_2$ bent inwardly of the half shell.

Each of these flat bearing surfaces $6_1$,$6_2$ is in the form of a strip which extends along a continuous closed mean line and surrounds two cavities (respectively $7_1$, $8_1$ and $7_2$, $8_2$) themselves separated from one another by a central step $9_1$, $9_2$.

Each step projects slightly beyond the plane of the corresponding flat bearing surface and is itself recessed by a flat cavity $10_1$, $10_2$, i.e. defined by two parallel walls perpendicular to the above mentioned plane, the mean plane of said cavity advantageously being a plane of symmetry for the half shell.

A flat key 11 is housed in the two opposite recesses $10_1$, $10_2$ with a horizontal clearance but without vertical clearance: in other words, this key joins the two half shells vertically together but is horizontally floating which makes possible the slight relative movements of these two half shells not only in direction H but also in horizontal rotation.

Key 11 has advantageously in plan view the form of an ellipse with small truncated ends whose large axis is contained in the above surface S and it is made from a material having high shear resistance, particularly from spring steel.

The elastic means for moving the two half shells $4_1$, $4_2$ apart essentially comprise here a relatively thick belt 12 made of elastomer material applied jointingly against the two flat peripheral bearing surfaces $6_1$, $6_2$ so as to sealingly isolate the interior of the complete shell thus formed and closed with respect to the outside. The jointing application of this belt 12 against the flat peripheral bearing surfaces $6_1$, $6_2$ is maintained, during positioning of the cartridge between the slabs to be joined together and after such positioning, by the mutual clamping of the two half shells in direction H, the effect of such clamping being to crush and compress said belt between these two half shells.

The belt may also be bonded to the opposite bearing surfaces, which renders their mutual jointing application irreversible, even before the cartridge is placed between the slabs to be joined.

The cross section of belt 12 is rectangular, or even square.

The elastomer constituting this belt has a good compressive strength and is unaffected by salt water: in particular, it is a synthetic Neoprene rubber of the SBR type whose Shore hardness is about 85.

Two double bosses 13, 14 integrally molded with belt 12, inside this latter and projecting on each side of its mean plane, are jointingly housed in cavity $7_1$, $7_2$ and $8_1$, $8_2$ of the half shells.

These bosses, the essential purpose of which is to ensure positioning of the belt in the half shells, are advantageously recessed on each side in direction H by tunnels 15 and 16, and grooves 23 are formed along the zone, in the molded piece 12, 13, 14, where the outer surfaces of the belt and of the bosses are joined: the empty volumes left in the elastomer by these tunnels and grooves make possible compression of the solid elastic material forming said molded piece.

The seal provided by said belt 12 between the inside and the outside of the shell protects the key 11 and its guides from humidity and foreign bodies (mud, sand, gravel . . . ), which eliminates the risks of seizure between the mutually sliding pieces.

This protection may be increased by filling the inner volume of the belt, i.e. substantially the clearance between the key 11 and its housings and the space between the opposite front areas of the two central steps $9_1$, $9_2$, at least partially with grease.

Figure 4:
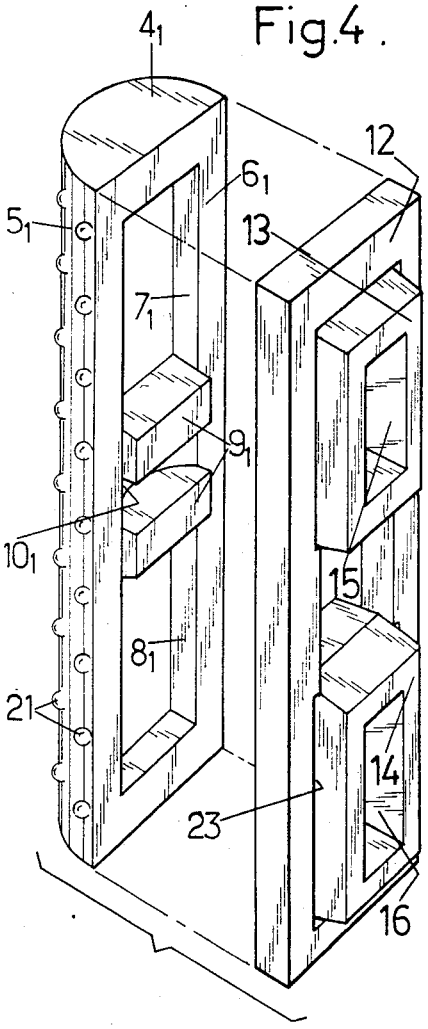
FIG. 4 shows in perspective two pieces constituting such a cartridge.

To improve the adherence of the cartridge to the concrete forming slabs 1, 2 during introduction thereof into the cylindrical hole 17 formed for this purpose, the outer surface of this cartridge is given a non smooth profile, i.e. having elements in relief formed thereon such as those shown at 21 in FIG. 4.

Figure 2:
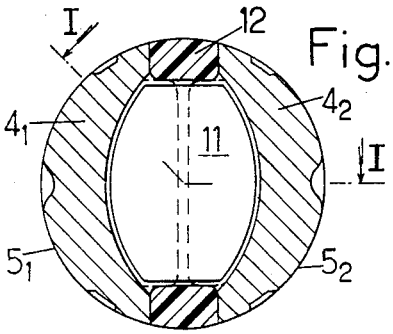
Figure 3:
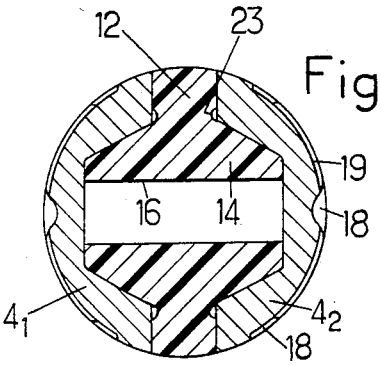

In a particularly advantageous embodiment of this arrangement, these relief elements are given the form of a ramified network composed of longitudinal canals 18 (FIGS. 1 to 3) and annular grooves 19 so as to cause the base of the cartridge to communicate with the major part of its outer surface: thus, it is sufficient to place at the bottom of hole 17 the liquid resin 22 intended for sealing or bonding the cartridge to the concrete, for the introduction of this cartridge into this hole to cause the reflux of this resin all around the cartridge, in the residual gap between said cartridge and the inner face of said whole.

To facilitate this introduction of the cartridge in hole 17, which introduction supposes a prior radial compression of the cartridge in direction H, the edges of the two axial ends of said cartridge are advantageously bevelled at 20.

Of course, the nature and dimensions of belt 12, as well as the degree of prior compression thereof, are chosen so that this belt remains permanently horizontally compressed after positioning between the two concrete slabs, even when the width of the crack separating these two slabs reaches its maximum value, which corresponds to the maximum contractions of said slabs and so to the lowest temperatures.

Consequently, and whatever the embodiment adopted, a cartridge for mutually joining the slabs of concrete is finally obtained whose construction and operation follows sufficiently from the foregoing.

This cartridge presents numerous advantages over those known in the prior art, particularly the following.

Its manufacture is simplified because the two functions of elastic expansion and sealing are provided by one and the same piece, namely the belt.

Its life span is improved: in fact, since the steps in which the housings for the key are formed are horizontally closer to each other than the peripheral bearing surfaces of the half shells, the bearing surfaces between the key and each half shell may be given a much greater area than when these surfaces are located in the immediate vicinity of said peripheral bearing surfaces.

This advantage is further reinforced if the key is given the form of a truncated ellipse: thus, the bearing surface considered easily exceeds in such a case 40% of the horizontal cross section of the piece whereas this percentage is less than 10% in prior known constructions.

Furthermore, the fact that the two steps may bear directly against each other before total crushing of the belt preserves the reversibility of the elasticity of this latter.

As is evident and is it follows moreover already from what has gone before the invention is in no wise limited to those of its modes of application and embodiments which have been more especially considered; it covers, on the contrary, all the variants thereof, more especially:

those where the peripheral bearing surfaces of the two half shells which serve as seat for the elastic belt are not flat but have for example certain portions mutually offset with respect to each other in direction H or else at least one peripheral groove or the like adapted to coact with a complementary surface of the belt, those where said peripheral bearing surfaces are not parallel to each other but for example flat and extending along two planes slightly inclined with respect to each other.

I claim:

1. In a device for joining together two concrete slabs (1, 2) juxtaposed side by side along a crack (3) and having two rigid semi-cylindrical half shells ($4_1$, $4_2$) which are joined together longitudinally, but not transversely, by a rigid inner key member (11), said half shells being urged transversely apart by elastic means and having two opposing peripheral bearing surfaces ($6_1$, $6_2$) joined together by a seal, the improvement comprising:

said elastic means including a relatively thick belt (12) interposed between the two peripheral bearing surfaces and itself forming the seal therebetween;

said half shells each having a step ($9_1$, $9_2$) forming a part of said half shells, said steps projecting toward each other and each step extending beyond the plane of the peripheral bearing surface of its respective half shell; and said key member being housed in two recesses ($10_1$, $10_2$) formed respectively in said two steps, said key member being slidable in said recesses transversely, but not longitudinally, of said half shells.

2. The joining device according to claim 1, characterized in that the key (11) is formed by a piece having in cross section the form of an ellipse with small truncated ends.

3. The joining device according to claim 1, characterized in that the steps ($9_1$, $9_2$) are disposed in the center of the half shells ($4_1$, $4_2$).

4. The joining device according to claim 1, characterized in that the belt (12) forms a single block with inner bosses (13, 14) housed respectively in complementary cavities ($7_1$, $8_1$; $7_2$, $8_2$) formed in the two half shells ($4_1$, $4_2$).

5. The joining device according to claim 4, characterized in that the bosses (13, 14) have relatively large dimensions and are recessed by tunnels (15, 16) which pass through them from one side to the other.

6. The joining device according to claim 4, characterized in that the monoblock piece made from elastic material forming the belt (12) and the bosses (13, 14) is recessed with grooves (23) along the connection zone between this belt and these bosses.

7. The joining device according to claim 1, characterized in that the volume inside the belt (12) is filled with grease.

8. A device for joining together two concrete slabs (1, 2) juxtaposed side by side along a crack (3), comprising:

two rigid semi-cylindrical half shells ($4_1$, $4_2$), said half shells having two steps ($9_1$, $9_2$) each projecting toward the other beyond the plane of the peripheral bearing surfaces ($6_1$, $6_2$) included in said half shells;

a rigid inner key (11) housed in two recesses ($10_1$, $10_2$) formed respectively by said two stages ($9_1$, $9_2$) joining together said half shells longitudinally but not transversely; and elastic means (12) interposed between said half shells for forming both a seal and a resilient joint between said half shells, said seal and resilient joint being between the two peripheral bearing surfaces.

9. A device for joining together two concrete slabs (1, 2) juxtaposed side by side along a crack (3), comprising:

two rigid semi-cylindrical half shells ($4_1$, $4_2$) having opposed, spaced-apart, peripheral bearing surfaces ($6_1$, $6_2$), said half shells each having a step ($9_1$, $9_2$) forming a part thereof, said steps projecting toward each other and each step extending beyond the plane of the peripheral bearing surface of its respective half shell;

a rigid inner key member (11) housed in opposing, open-faced recesses ($10_1$, $10_2$) formed respectively in said two steps for joining together said half shells longitudinally but not transversely, said key member being adapted to slide transversely of said half shells in said recesses;

a thick belt of elastic material (12) disposed between and joining together said peripheral bearing surfaces, said belt comprising means for forming a seal between said bearing surfaces and for resiliently urging said half shells transversely away from one another; and said steps having opposed end faces adapted to abut each against the other upon a predetermined transverse movement of said half shells toward one another for limiting the compression of said belt to an amount which preserves its elasticity.

* * * * *